US008672626B2

(12) United States Patent
Boy et al.

(10) Patent No.: US 8,672,626 B2
(45) Date of Patent: Mar. 18, 2014

(54) ENGINE ASSEMBLED SEAL

(75) Inventors: Lynn M. Boy, Durham, CT (US); Tracy A. Propheter-Hinckley, Manchester, CT (US); Malcolm C. Staddon, Middlefield, CT (US)

(73) Assignee: United Technologies Corporation, Hartford, CT (US)

( * ) Notice: Subject to any disclaimer, the term of this patent is extended or adjusted under 35 U.S.C. 154(b) by 888 days.

(21) Appl. No.: 12/764,212

(22) Filed: Apr. 21, 2010

(65) Prior Publication Data

US 2011/0262274 A1 Oct. 27, 2011

(51) Int. Cl.
*F01D 5/10* (2006.01)

(52) U.S. Cl.
USPC ..... 416/1; 416/500

(58) Field of Classification Search
USPC ..... 277/411, 412, 413, 421; 416/1, 193 A, 416/193 R, 200 R, 500
See application file for complete search history.

(56) References Cited

U.S. PATENT DOCUMENTS 4,516,910 A * 5/1985 Bouiller et al. ..... 416/190
4,872,810 A 10/1989 Brown et al.
5,228,835 A 7/1993 Chlus
5,261,790 A * 11/1993 Dietz et al. ..... 416/193 A
5,513,955 A 5/1996 Barcza
5,573,375 A * 11/1996 Barcza ..... 416/193 A
5,785,499 A * 7/1998 Houston et al. ..... 416/248
5,827,047 A * 10/1998 Gonsor et al. ..... 416/193 A
5,924,699 A 7/1999 Airey et al.
6,171,058 B1 1/2001 Stec
6,932,575 B2 8/2005 Surace et al.
7,121,800 B2 10/2006 Beattie
8,011,892 B2 * 9/2011 Ramlogan et al. ..... 416/190
2011/0262274 A1 * 10/2011 Boy et al. ..... 416/174
2013/0195665 A1 * 8/2013 Snyder et al. ..... 416/174

* cited by examiner

*Primary Examiner* — Edward Look
*Assistant Examiner* — Christopher R Legendre
(74) *Attorney, Agent, or Firm* — Bachman & LaPointe, P.C.

(57) ABSTRACT

A system for creating a seal between a damper and a platform of a turbine engine component includes a turbine engine component having an airfoil portion, a platform, and a fir tree for joining the turbine engine component to a rotor, a damper located in an area beneath the platform, a seal having a sealing surface which seats against an underside of the platform, which seal has a seal retention feature which bends into contact with an underside of the damper, and which seal with the seal retention feature has a center of gravity which allows the seal retention feature to bend up as result of rotational movement of the rotor. A method for creating the seal is also described.

12 Claims, 4 Drawing Sheets

ENGINE ASSEMBLED SEAL

BACKGROUND

The present disclosure relates to a seal for a turbine engine component, such as a turbine blade.

Current turbine blade technology involves creating dampers which do not significantly change their shape when a turbine engine is brought up to speed. The seals associated with the dampers are manually trapped into position as the engine is being assembled.

There are some disadvantages associated with the current blade seal technology. For example, special tooling is required if it is necessary to bend the seal such that it wraps around another part in order to keep itself in position. This special tooling could leave tool marks on the part. Any such tool marks potentially create high areas of stress that could cause the part to fail while the engine is running. Also, assembling the parts in this manner could prohibit the seal from finding its proper position and thereby compromise the sealing function. Still another issue has to do with the relatively small size of these parts. Repetitive handling and working of the parts could lead to ergonomic issues.

In prior configurations, the seal for the turbine blade was designed such that it leaned against the blade aft buttress in order to keep it in place. However, the center of gravity of this position caused high cycle fatigue issues and a tab associated with the seal either stayed where it was designed, fold up under the damper, or vibrate itself so much that it would break off and liberate itself into the gas path.

SUMMARY

In accordance with the instant disclosure, there is provided a system broadly comprising: a turbine engine component having an airfoil portion, a platform, and means for joining said turbine engine component to a rotor; a damper located in an area beneath the platform; a seal having a sealing surface which seats against an underside of said platform; said seal having a seal retention feature which bends into contact with an underside of said damper; and said seal with said seal retention feature having a center of gravity which allows said seal retention feature to bend up as result of rotational movement of said rotor.

Further in accordance with the instant disclosure there is provided a method for creating a seal between a platform portion of a turbine engine component and a damper, said method comprising the steps of: providing a damper having a downwardly extending leg and a hole in said leg; providing a seal having a seal retention feature; positioning said seal against a face of said damper and passing said seal retention feature through said hole; and bending said seal retention feature so that said seal retention feature positions itself in contact with an underside of said damper, said bending step comprising rotating a rotor to which said turbine engine component is attached at a speed which causes said seal retention to bend and move into said contact with said underside of said damper.

Other details of the engine assembled seal are set forth in the following detailed description and the accompanying drawings, wherein like reference numerals depict like elements.

DETAILED DESCRIPTION OF THE PREFERRED EMBODIMENT(S)

Figure 1:
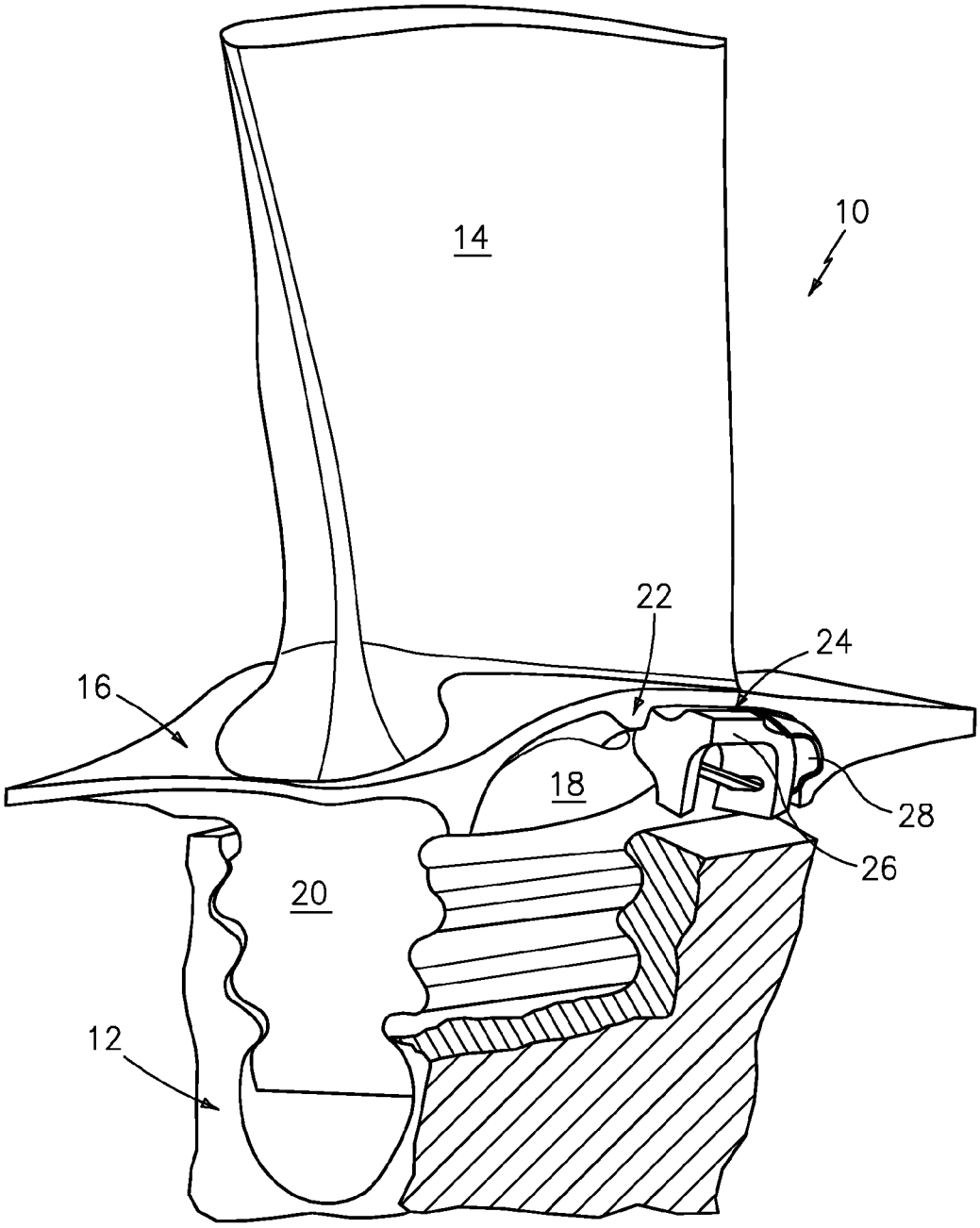
FIG. 1 is a schematic representation of a turbine blade assembled to a turbine rotor.

Referring now to FIG. 1, there is illustrated a turbine blade 10 assembled into a break away section of a turbine rotor 12. The turbine blade 10 has an airfoil portion 14, an integrally formed platform 16, and under platform area 18, a fir tree 20 for securing the turbine blade 10 to the rotor 12, a damper positioning nub 22, and an underside area 24 under the platform 16 into which a blade damper 26 and a seal 28 are positioned.

Figure 2:
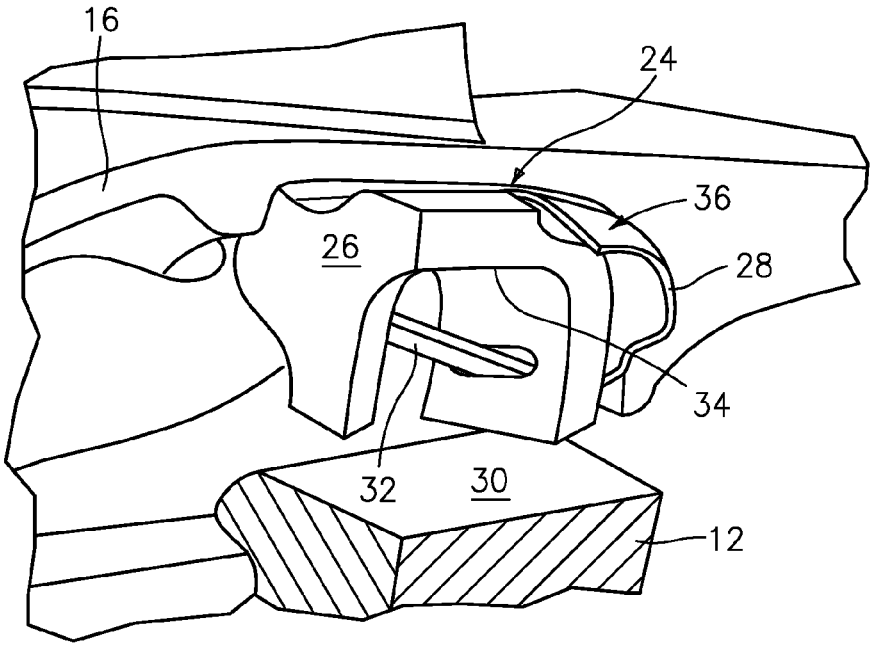
FIG. 2 is a schematic representation of a damper and seal located in an area beneath a turbine blade platform.

Referring now to FIG. 2, there is shown a close up of the damper 26 and the seal 28 in the area 24 beneath the platform 16 and the top 30 of the rotor 12. FIG. 2 shows the seal 28 as it is initially assembled into the engine with respect to the turbine blade 10. The seal 28 is provided with a seal retention feature 32. Both the seal 28 and the seal retention feature 32 may be formed as a unitary structure and may be formed from a suitable material. The material forming the seal 28 and the seal retention feature 32 may be a nickel based alloy such as a WASPALOY® alloy, or a cobalt based alloy. FIG. 2 schematically illustrates the seal retention feature 32 prior to it bending up to contact and conform to an underside 34 of the damper 26 and prior to the sealing surface 36 of the seal 28 seating itself against the underside 24 of the platform 16.

Figure 3:
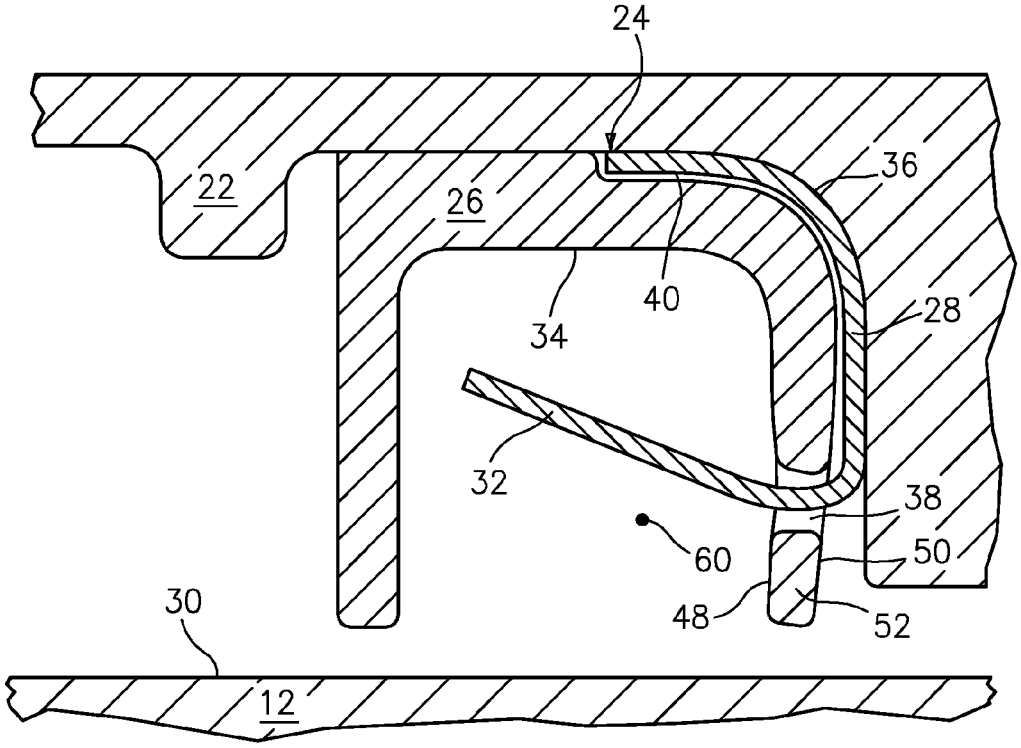
FIG. 3 is a sectional view of a damper having a seal as positioned at engine assembly.

FIG. 3 is a sectional view of the seal 28 showing the seal 28 and the damper 26 as they would be positioned with the aid of one or more adherents, such as glue and beeswax, at engine assembly. As shown in FIG. 3, the seal retention feature 32 is unbent and fed through a hole 38 in the damper 26. The underside 40 of the sealing surface 36 of the seal 28 is glued to the damper 26. Further, the damper 26 and the seal 28 are glued to the underside area 24 of the platform 16, aft of the damper positioning nub 22 and above the top 30 of the rotor 12.

Figure 4:
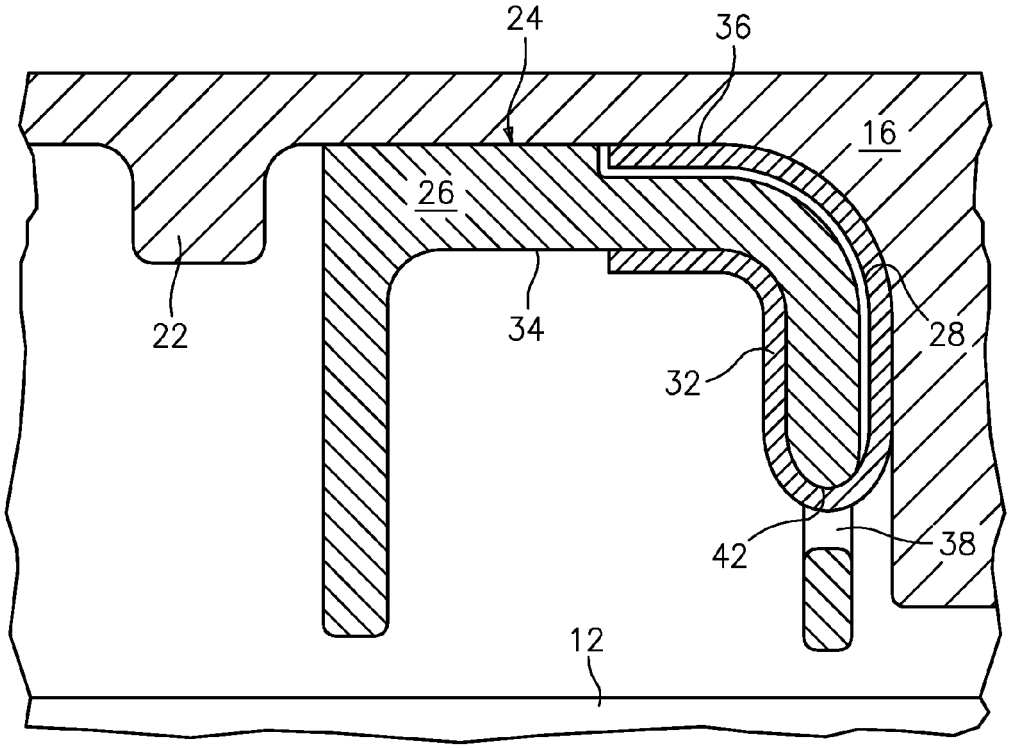
FIG. 4 is a sectional view of the damper and seal assembly after the engine has been spun up to minimum idle.

FIG. 4 shows the damper 26 and the seal 28 after the seal 28 has assumed a sealing position after the engine has been spun up to minimum idle. At minimum idle, the rotor 12 is rotating at a rotational rate. The rotational rate will vary from engine to engine. As shown in FIG. 4, the damper 26 and the sealing surface 36 of the seal 28 are pushed against the underside 24 of the platform 16. As can be seen from this figure, the seal retention feature 32 has bent itself around the top 42 of the hole 38 in the damper 26 and conformed to and positioned itself in contact with the underside 34 of the damper 26.

Figure 5:
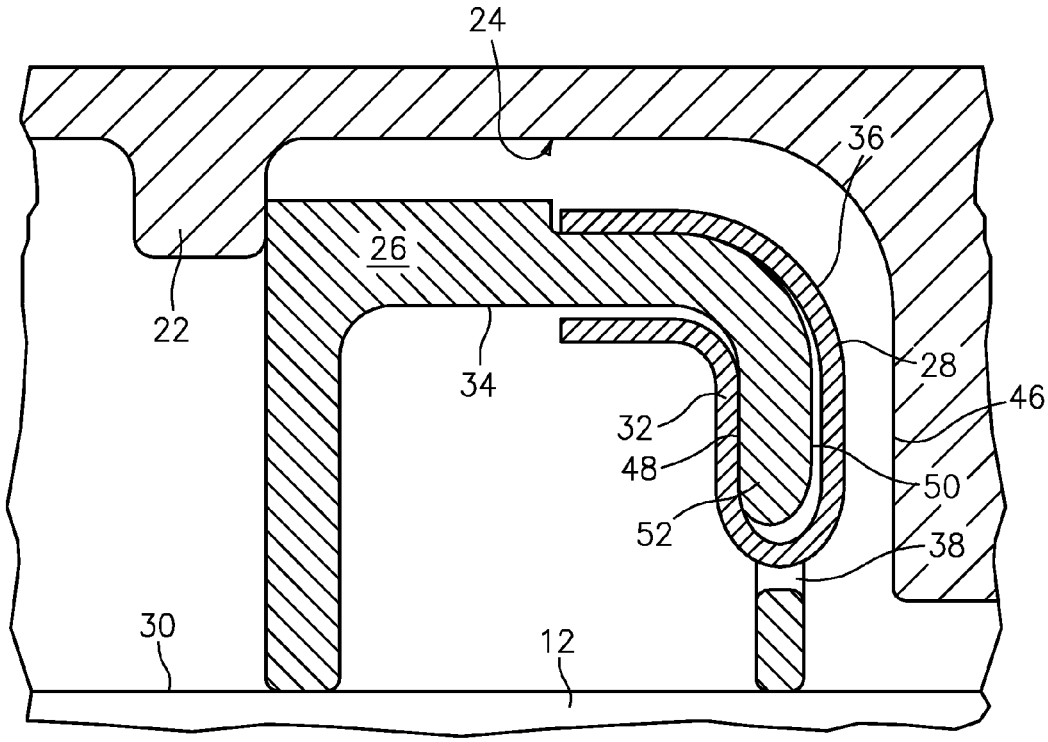
FIG. 5 is a sectional view of the damper and seal assembly after green run.

FIG. 5 shows the components after green run of the engine when all the adherents, such as glue, have been burnt away. The damper 26 has fallen away from the underside 24 of the platform 16 and is resting on the top 30 of the rotor 12. The damper 26 typically moves forward such that it can touch the damper positioning nub 22. The damper 26 is capable of resting anywhere between the nub 22 and the airfoil buttress 46. Since the adherent has melted, the seal 28 has a loose fit with the damper 26; however, the seal 28 can not fall out because the seal retention feature 32 has been bent by the rotation of the engine. The seal 28 can fall away from the bottom surface or underside 34 of the damper 26, but is prevented from falling further because of the sealing portion 36 of the seal 28. It should be noted that the seal 28 is pinned from going forward and aft by the forward and aft vertical surfaces 48 and 50 of the downwardly extending leg 52 of the damper 26.

Bending of the seal retention feature 32 into the position shown in FIG. 4 is brought about by providing a seal 28 which has a center of gravity 60 (see FIG. 3) which is located beneath the underside 34 of the damper 26 and forward of the forward vertical surface 48 of the downwardly extending leg 52 of the damper 26. Naturally, the seal 28 has a length and a weight which allows the center of gravity 60 to be located in the aforesaid position. The location of the center of gravity in the aforesaid position helps create a longer moment arm. As a result, rotational movement of the rotor 12, caused by rotation of the engine, causes the seal retention feature 32 to bend up into the position shown in FIG. 4 prior to the onset of vibratory conditions prior to minimum idle. It has been found that the seal retention feature will begin to bend up prior to the rotation rate of the rotor at minimum idle. In a particularly useful mode of operation, the seal retention feature 32 begins to bend up at 50% to 80% of the rotational rate of the rotor 12 at minimum idle. Further, the seal retention feature 32 begins to bend up at a temperature less than the temperature which is encountered at minimum idle. Of course, it should be appreciated that different engines will have different rotational rates and temperatures at minimum idle. However, regardless of the engine, the seal and the seal retention feature will function as described hereinabove. The seal retention feature 32 and the weight and length of the seal 28 creates a large enough moment arm and mass such that when the engine is brought up to minimum idle for the first time during green run, the seal 28 will properly seat itself against the under platform of the blade, thereby assuring proper sealing and bending of the seal retention feature 32 into its final assembled position underneath the damper 26. The final position of the seal retention feature 32 keeps the seal 28 from vibrating because it is fully supported by the damper and keeps the seal 28 from misalignment and falling out when the engine is turned off.

The seal 28 with the seal retention feature 32 described herein eliminates small repetitive motion ergonomic issues, allows the seal to properly be seated, avoids tool marking issues, and keeps the seal from misalignment and liberation after green run when assembly glue has been burnt away.

Figure 6:
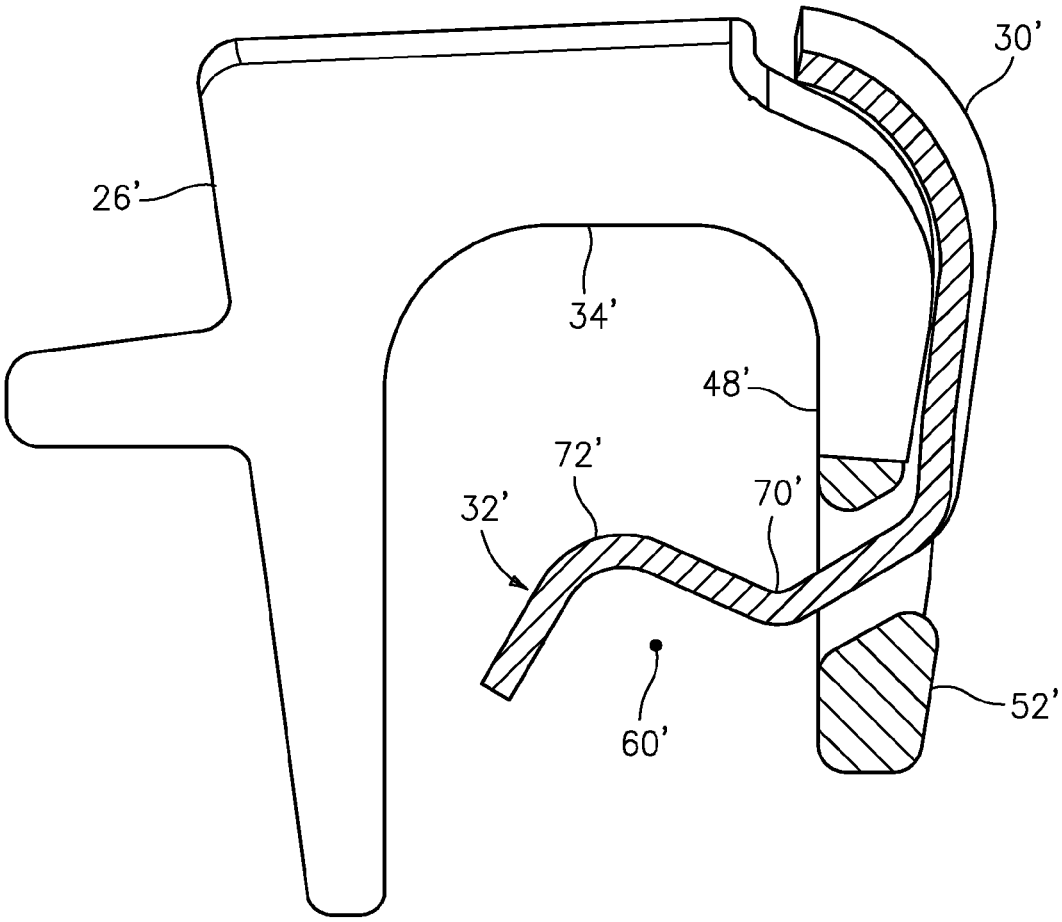
FIG. 6 illustrates an alternative embodiment of a seal having a seal retention feature.

Referring now to FIG. 6, there is shown a seal 30' with a seal retention feature 32' which can be used to create an effective seal between the underside of a platform and a damper. The seal 30' is of such weight and length that the center of gravity 60' is located forward of the forward surface 48' of the downwardly extending leg 52' of the damper 26' and beneath the underside 34' of the damper 26'. The seal retention feature 32' may be made up of a plurality of angular sections creating a valley 70' and a peak 72'

There has been provided in accordance with the instant disclosure an engine assembled seal. While the seal has been described in the context of specific embodiments thereof, other unforeseen alternatives, modifications, and variations may become apparent to those skilled in the art having read the foregoing description. Accordingly, it is intended to embrace those alternatives, modifications, and variations as fall within the broad scope of the appended claims.

What is claimed is:

1. A method for creating a seal between a platform portion of a turbine engine component and a damper, said method comprising the steps of:

providing a damper having a downwardly extending leg and a hole in said leg;

providing a seal having a seal retention feature;

positioning said seal against a face of said damper and passing said seal retention feature through said hole; and bending said seal retention feature so that said seal retention feature positions itself in contact with an underside of said damper, said bending step comprising rotating a rotor to which said turbine engine component is attached at a speed which causes said seal retention to bend and move into said contact with said underside of said damper.

2. The method according to claim 1, wherein said seal providing step comprises providing a seal having a center of gravity which is located forward of said downwardly extending leg.

3. The method according to claim 1, wherein said rotating step comprises rotating said rotor at a rotational speed less than a rotational speed of said rotor at minimum idle.

4. The method according to claim 1, wherein said rotating step comprises rotating said rotor at a rotational speed which is 50% to 80% of a rotational speed of said rotor at minimum idle.

5. The method according to claim 1, further comprising adhering an underside of said seal to the damper and adhering both the damper and said seal to an underside of the platform.

6. The method according to claim 5, wherein said step of adhering said seal to the damper comprises gluing said seal to said damper and said step of adhering both the damper and the seal to the underside of the platform comprises gluing said damper and said seal to said underside of the platform.

7. A system comprising:

a turbine engine component having an airfoil portion, a platform, and means for joining said turbine engine component to a rotor;

a damper located in an area beneath the platform, said damper having a downwardly extending leg with a hole;

a seal having a sealing surface which seats against an underside of said platform;

said seal having a seal retention feature which bends into contact with an underside of said damper, said seal retention feature passes through said hole in said downwardly extending leg; and said seal with said seal retention feature having a center of gravity which allows said seal retention feature to bend up as a result of rotational movement of said rotor and said center of gravity being located forward of a front face of said downwardly extending leg.

8. The system according to claim 7, wherein said center of gravity is located beneath said platform.

9. The system according to claim 7, wherein said seal having said seal retention feature is formed from one of a nickel based alloy and a cobalt based alloy.

10. The system according to claim 7, wherein said seal retention feature bends up at a rotor rotational rate less than a rotational rate for said rotor at minimum idle.

11. The system according to claim 7, wherein said seal retention feature bends up at a rotor rotational rate which is from 50% to 80% of a rotational rate for said rotor at minimum idle.

12. The system according to claim 11, wherein said seal retention feature bends up at a temperature less than a temperature at said minimum idle.

* * * * *